US006053218A

United States Patent [19]

Boers

[11] Patent Number: 6,053,218

[45] Date of Patent: Apr. 25, 2000

[54] SEMI-AUTOMATED SYSTEM FOR DISPENSING AUTOMOTIVE PAINT

[75] Inventor: Arie Boers, Plymouth, Minn.

[73] Assignee: X-Pert Paint Mixing Systems, Inc., Roseville, Minn.

[21] Appl. No.: 09/189,214

[22] Filed: Nov. 10, 1998

[51] Int. Cl.[7] ..... B65B 1/30

[52] U.S. Cl. ..... 141/83; 141/18; 141/100; 141/104; 141/192; 141/247; 141/284; 222/160; 222/164; 222/166; 222/504; 177/60

[58] Field of Search ..... 141/18, 83, 100, 141/104, 192, 196, 247, 284, 391; 222/77, 160, 164, 166, 504; 177/60, 61, 64; 251/62, 63.4

[56] References Cited

U.S. PATENT DOCUMENTS

| | | | |
|---|---|---|---|
| 2,027,297 | 1/1936 | Tramposch | 259/107 |
| 2,035,646 | 3/1936 | Farrington | 259/108 |
| 2,068,646 | 1/1937 | Hexter | 226/100 |
| 2,423,969 | 7/1947 | Foltz | 259/58 |
| 2,428,492 | 10/1947 | Haller | 259/67 |
| 2,521,384 | 9/1950 | Marienthal | 259/66 |
| 2,585,334 | 2/1952 | McCauley | 220/55 |
| 2,603,461 | 7/1952 | Marienthal | 259/64 |
| 2,636,643 | 4/1953 | McCauley | 222/80 |
| 2,757,910 | 8/1956 | O'Neill | 259/108 |
| 2,802,649 | 8/1957 | Stockton | 259/67 |
| 2,898,094 | 8/1959 | O'Neill, Jr. | 259/116 |
| 2,965,363 | 12/1960 | Worden | 259/67 |
| 3,021,118 | 2/1962 | Dedoes | 259/43 |
| 3,041,052 | 6/1962 | Dedoes | 259/122 |
| 3,118,653 | 1/1964 | Dedoes | 259/66 |
| 3,147,891 | 9/1964 | Fielitz | 222/166 |
| 3,162,338 | 12/1964 | Grubelic | 222/484 |
| 3,175,808 | 3/1965 | Dedoes | 259/107 |
| 3,284,057 | 11/1966 | Duquette | 259/88 |
| 3,350,083 | 10/1967 | Buhrer et al. | 266/38 |
| 3,412,937 | 11/1968 | Chamberlain | 239/142 |
| 3,670,785 | 6/1972 | Heiss et al. | 141/9 |
| 3,797,744 | 3/1974 | Smith | 239/172 |
| 3,930,598 | 1/1976 | Slagle | 222/129.4 |
| 4,090,475 | 5/1978 | Kwan | 222/70 |
| 4,163,523 | 8/1979 | Vincent | 239/305 |
| 4,225,248 | 9/1980 | Para | 366/251 |
| 4,299,500 | 11/1981 | Bassetti | 366/198 |
| 4,372,666 | 2/1983 | Kaufmann | 354/298 |
| 4,380,399 | 4/1983 | Godat et al. | 366/289 |
| 4,407,584 | 10/1983 | Boudin et al. | 366/279 |
| 4,538,222 | 8/1985 | Crain et al. | 364/172 |
| 4,585,148 | 4/1986 | Ito | 222/77 |
| 4,630,654 | 12/1986 | Kennedy, Jr. | 141/83 |
| 4,671,892 | 6/1987 | Bereiter | 252/370 |

(List continued on next page.)

FOREIGN PATENT DOCUMENTS

| | | | |
|---|---|---|---|
| 0 127 589 A2 | 12/1984 | European Pat. Off. | B44D 3/00 |
| 2742072 | 1/1998 | France | B01F 15/00 |
| 2 203 059 | 10/1988 | United Kingdom | B01F 7/16 |

*Primary Examiner*—Henry J. Recla
*Assistant Examiner*—Timothy L. Maust
*Attorney, Agent, or Firm*—Dicke, Billig & Czaja, P.A.

[57] ABSTRACT

A system for dispensing liquid paint components from their original containers into a paint receptacle according to a paint formula to form a liquid paint mixture. The dispensing system comprises a dispensing apparatus for dispensing the liquid paint component from its original container, and an apparatus for controlling the dispensing apparatus. The dispensing apparatus includes a mechanism for releasably receiving the original container of the liquid paint component, and a mechanism for dispensing the liquid paint component from its original container into the paint receptacle. The control apparatus includes a weigh cell and a control module coupled to the weigh cell and the dispensing mechanism. The weigh cell supports the paint receptacle to determine the weight of the liquid paint component dispensed into the paint receptacle. The control module controls the amount of the liquid paint component dispensed from its original container into the receptacle based upon information obtained from the weigh cell. The dispensing system virtually eliminates liquid paint component dispensing errors, thereby enhancing the efficiency of the dispensing system operator.

56 Claims, 8 Drawing Sheets

U.S. PATENT DOCUMENTS

| | | | |
|---|---|---|---|
| 4,691,850 | 9/1987 | Kirschmann et al. | 222/642 |
| 4,781,312 | 11/1988 | Strazdins | 222/309 |
| 4,792,236 | 12/1988 | Heinis et al. | 366/245 |
| 4,845,965 | 7/1989 | Copeland et al. | 68/17 R |
| 4,898,308 | 2/1990 | Rudlick | 222/325 |
| 4,926,390 | 5/1990 | Murzsa | 366/249 |
| 4,941,596 | 7/1990 | Marty et al. | 222/144.5 |
| 4,946,100 | 8/1990 | Flemming et al. | 239/1 |
| 4,967,938 | 11/1990 | Hellenberg | 222/144 |
| 4,976,137 | 12/1990 | Decker et al. | 73/53 |
| 5,020,700 | 6/1991 | Krzywdziak et al. | 222/487 |
| 5,020,917 | 6/1991 | Homan | 366/161 |
| 5,027,284 | 6/1991 | Senghaas et al. | 364/479 |
| 5,056,686 | 10/1991 | Jarrett | 222/129.2 |
| 5,078,302 | 1/1992 | Hellenberg | 222/144 |
| 5,094,543 | 3/1992 | Mursa | 366/247 |
| 5,096,071 | 3/1992 | Neri | 211/71 |
| 5,115,842 | 5/1992 | Crafts et al. | 141/286 |
| 5,119,973 | 6/1992 | Miller et al. | 222/144 |
| 5,153,825 | 10/1992 | Yauk et al. | 364/401 |
| 5,156,194 | 10/1992 | Von Nehring et al. | 141/1 |
| 5,160,198 | 11/1992 | Fillon | 366/198 |
| 5,169,232 | 12/1992 | Fillon et al. | 366/249 |
| 5,199,788 | 4/1993 | Stallings | 366/247 |
| 5,203,366 | 4/1993 | Czeck et al. | 137/3 |
| 5,251,979 | 10/1993 | Larsen | 366/248 |
| 5,310,258 | 5/1994 | Godat et al. | 366/251 |
| 5,335,806 | 8/1994 | Dedoes | 220/358 |
| 5,358,153 | 10/1994 | Caldwell et al. | 222/505 |
| 5,368,388 | 11/1994 | Fillon | 366/245 |
| 5,368,389 | 11/1994 | Dedoes | 366/247 |
| 5,413,257 | 5/1995 | Amberger et al. | 222/472 |
| 5,437,385 | 8/1995 | Fillon | 220/238 |
| 5,454,639 | 10/1995 | Krzywdziak | 366/279 |
| 5,456,534 | 10/1995 | Krzywdziak | 366/249 |
| 5,472,277 | 12/1995 | Dedoes | 366/247 |
| 5,474,211 | 12/1995 | Hellenberg | 222/1 |
| 5,482,370 | 1/1996 | Dedoes | 366/247 |
| 5,496,109 | 3/1996 | Dedoes | 366/198 |
| 5,498,076 | 3/1996 | Krzywdziak | 366/245 |
| 5,498,077 | 3/1996 | Krzywdziak | 366/247 |
| 5,503,474 | 4/1996 | Krzywdziak | 366/347 |
| 5,511,878 | 4/1996 | Dedoes | 366/198 |
| 5,533,802 | 7/1996 | Garganese | 366/256 |
| 5,542,761 | 8/1996 | Dedoes | 366/198 |
| 5,586,822 | 12/1996 | Krzywdziak | 366/247 |
| 5,603,426 | 2/1997 | Krzywdziak et al. | 220/324 |
| 5,622,289 | 4/1997 | Dedoes | 222/472 |
| 5,676,463 | 10/1997 | Larsen | 366/251 |
| 5,697,703 | 12/1997 | Lucchetti | 366/198 |
| 5,800,057 | 9/1998 | Lesimple | 366/198 |
| 5,813,760 | 9/1998 | Strong | 366/258 |
| 5,839,825 | 11/1998 | Krzywdziak | 366/247 |
| 5,904,420 | 5/1999 | Dedoes | 366/198 |
| 5,947,598 | 9/1999 | Dedoes | 366/198 |
| 5,988,868 | 11/1999 | Dedoes | 366/198 |

SEMI-AUTOMATED SYSTEM FOR DISPENSING AUTOMOTIVE PAINT

TECHNICAL FIELD

This invention relates to mixing paint components, such as colorants, tints and pearls, according to automotive paint formulas. In particular, the present invention is semi-automated system for dispensing paint components, according to a desired paint formula, that does not require a system operator to manually dispense measured quantities of the paint components.

CROSS REFERENCE TO RELATED APPLICATIONS

This patent application is related to U.S. patent application Ser. No. 09/189,338, entitled "Paint Container Lid for a Semi-Automated Automotive Paint Dispensing System" filed on even date herewith, assigned to the same assignee, and incorporated herein by reference thereto.

BACKGROUND OF THE INVENTION

In the automotive body repair industry, paint vendors provide auto body repair businesses, such as body shops and jobbers, with their paint formulas. Generally, these paint formulas are a composition (i.e., mixture) of paint components, such as colorants, tints, pearls, metallics, binders and/or balancers, that, once mixed, produce the desired color of paint to be applied to a repaired vehicle. The paint formulas of the paint vendors are formulated to match the colors that have been applied to vehicles by new car manufacturers over the years. In addition, these paint formulas contain variants, to match the color fading of paint that can occur to a vehicle over years of service. Moreover, the palettes of paint formulas of the paint vendors also contain custom colors (i.e., unconventional colors not typically used by vehicle manufacturers) that may be used to produce special finishes for custom or show cars. Hence, paint vendors provide body shops and jobbers with literally thousands of paint formulas for producing the vast spectrum of colors needed in the automotive body repair industry.

In the past, paint vendors would provide the body shops and jobbers with microfiche containing their paint formulas. Today the paint formulas are stored in computer memory. To determine the particular paint formula for a particular vehicle repair/paint job, a system operator, such as an employee of the body shop or jobber, first obtains the color code from the vehicle. This color code is typically part of the vehicle's identification number. In the case of an unconventional color, to be used to produce a custom paint finish, the code for a particular color is obtained from a catalog. This color code is then entered into the microprocessor of the computer, which accesses the computer memory, and displays, via a monitor, the paint vendor's paint formula which matches the identified vehicle color code.

The paint formulas are displayed according to the weight of the different paint components for mixing specific quantities of the paint formula, and the order in which the displayed paint components are to be mixed. Typically, paint formula mixing quantities are listed in quart, half gallon and gallon sizes, while the weight of the particular paint components needed to mix the desired quantity of paint, are listed in grams to a precision of a tenth of a gram. Generally, the paint components comprising tints, colorants, pearls and/or metallics are mixed first, while the paint components comprising binders and/or balancers are added last. Depending on the desired color, the paint formula can require just a few paint components, or over a dozen paint components, that must be mixed with a great degree of precision, to achieve a perfect color match.

Once the system operator determines that the correct desired paint formula is displayed on the computer monitor, the operator places a paint receptacle on a weigh cell that is linked to the microprocessor of the computer. Generally, a receptacle larger than the quantity of the paint formula to be mixed is used to accommodate any excess paint inadvertently mixed by the operator. With the receptacle on the weigh cell, the weigh cell is zeroed by the operator, to make ready for the process of adding paint components to the receptacle to mix the desired color paint formula. Typically, the various paint components (of which there are dozens) are stored in containers kept within a rack. The rack has a mechanism that periodically stirs the paint components within the containers, so that the various paint components are ready to be dispensed as part of the paint formula mixing process. The system operator then locates the first listed paint component, of the paint formula to be mixed, and pours, by hand, the paint component into the weigh cell supported paint receptacle, until the weight of the paint component dispensed (i.e., poured) to the receptacle matches what is displayed on the computer monitor. The operator continues along on this course (i.e., hand pouring the paint components from their containers), until the correct weight of all paint components, needed to mix the desired color paint formula, have been added to the paint receptacle atop the weigh cell.

Although the above described system for mixing paint components, according to a paint formula, allows a skilled system operator to adequately recreate paint colors needed for repair/paint jobs, there are some disadvantages to this system. For example, to mix a desired paint formula requires that the paint components be added to the paint receptacle, atop the weigh cell, with a great degree of accuracy. This accuracy, as stated earlier, is typically to a precision of 0.1 grams. For even a highly skilled operator this great degree of precision is difficult to obtain when hand pouring the paint components needed to mix the desired paint formula. It is especially difficult when many paint components must be poured into the paint receptacle in order to duplicate the paint formula.

The most common error on the part of the system operator of the body shop or jobber is over pouring, which is due primarily to the manual labor intensive nature of the paint component dispensing process. Over pouring occurs when the weight of the paint component added to the receptacle atop the weigh cell, exceeds the weight of the component shown on the computer display for the desired paint formula. When this happens, the microprocessor of the computer recalculates the weights of the other paint components that need to be added to the receptacle to compensate for the over poured component. This recalculation is done automatically by the microprocessor since the weigh cell is linked to the computer. Based upon this recalculation, the system operator then needs to re-pour the other paint components to offset the over poured component of the paint formula.

While this re-pouring task may not be difficult when the paint formula only has a few paint components, the re-pouring task is particularly time consuming when there is a great number of components in the paint formula. Specifically, if an over pouring error is made in the last paint component of a series of ten components of a paint formula, then all of the previous nine components may have to be re-poured to compensate. This re-pouring task may be further complicated if another error is made during the re-pouring of the paint components as it may require some components to be re-poured two or three times until the paint formula is finally accurately reproduced. Hence, over pouring errors can be costly to a body shop or jobber because of the additional man hours needed to accurately mix the paint formula.

Not only are over pouring errors expensive because of the additional man hours needed to reproduce the paint formula, over pouring errors arc also costly in the amount of additional paint formula that is mixed because of the errors. Automotive paint can cost in excess of $100.00 per quart. An over pouring error of just one pint may translate into an additional cost of $50.00 that a body shop or jobber may have to absorb, unless this additional paint cost can be justified to an automobile collision insurance carrier. Moreover, this additional paint, if not used in the repair/paint job, becomes a hazardous waste that must be disposed of properly, thereby adding still more costs that are attributable to paint component over pouring errors.

There is a need for an improved system for dispensing paint components according to a paint formula. In particular, there is a need for a system for dispensing paint components of a paint formula that substantially eliminates system operator errors, specifically over pouring errors, that can be costly to a body shop or jobber. The paint component dispensing system should be easy to use, so as not to require a highly skilled operator, and should make better use of an operator's time to allow an operator to mix a greater number of paint formulas during a work day. In addition, the paint component dispensing system should comply with all regulations and laws governing the handling and mixing of paint components for the duplication of automotive paint formulas.

SUMMARY OF THE INVENTION

The present invention is a system for dispensing pourable components, such as liquid paint components, from their original containers into a receptacle according to a formula to form a mixture of pourable components, such as a liquid paint mixture. The dispensing system comprises a dispensing apparatus for dispensing the liquid paint component from its original container, and an apparatus for controlling the dispensing apparatus. The dispensing apparatus includes a support frame, a mechanism coupled to the support frame for releasably receiving the original container, and a mechanism coupled to the support frame for dispensing the liquid paint component from its original container into a receptacle, such as a paint receptacle. The control apparatus includes a weigh cell and a control module coupled to the weigh cell and the dispensing mechanism. The weigh cell supports the paint receptacle to determine the weight of the liquid paint component dispensed into the paint receptacle. The control module controls the amount of the liquid paint component dispensed from its original container into the receptacle based upon information obtained from the weigh cell.

The dispensing mechanism of the dispensing apparatus includes an operating device for releasably engaging a movable cover element of the original container of the liquid paint component. The operating device is movable between a first position and a second position. In the first position, the cover element is in a closed state and the liquid paint component is prevented from being dispensed from the original container. In the second position, the cover element is in an opened state and the liquid paint component is dispensed from the original container and into the paint receptacle. The support frame of the dispensing apparatus includes a main support structure and an ancillary support structure that is movable relative to the main support structure. The mechanism for releasably receiving the original container includes first and second mechanisms for engaging first and second portions of the original container of the paint component. The first and second engaging mechanisms are mounted to the main and ancillary support structures, respectively. The ancillary support structure is movable between a primary position and a secondary position. In the primary position, the first and second engaging mechanisms receive a quart size of the original container of the liquid paint component. In the secondary position, the first and second engaging mechanisms receive a gallon size of the original container of the liquid paint component.

This semi-automated dispensing system, for dispensing liquid paint components from their original containers according to a paint formula to form a liquid paint mixture, virtually eliminates system operator errors, in particular over pouring errors, that can be costly to a body shop or jobber. The semi-automated dispensing system is easy to use, and does not require a highly skilled operator, since operator interface with the dispensing system is substantially limited to identifying the desired paint formula, and loading and unloading the proper containers of the liquid paint components to and from the dispensing apparatus. In the semi-automated dispensing system of the present invention, the operator need no longer manually pour the paint components from their containers. The control module controlled dispensing mechanism of the semi-automated dispensing system automatically dispenses (i.e., pours) the liquid paint components from their containers, thereby ensuring a highly accurate, precision liquid paint component pour. In addition, the paint dispensing system makes efficient use of the operator's time, since the operator is free to perform other duties instead of holding the containers and performing the task of manually pouring the proper amounts of the liquid paint components. This efficiency gain allows the operator to mix a greater number of paint formulas during a work day. Lastly, the semi-automated dispensing system of the present invention complies with all regulations and laws, such as being explosion protected, governing the handling and mixing of liquid paint components for the duplication of automotive paint formulas.

BRIEF DESCRIPTION OF THE DRAWINGS

The accompanying drawings are included to provide a further understanding of the present invention and are incorporated in and constitute a part of this specification. The drawings illustrate the embodiments of the present invention and together with the description serve to explain the principals of the invention. Other embodiments of the present invention and many of the intended advantages of the present invention will be readily appreciated as the same become better understood by reference to the following detailed description when considered in connection with the accompanying drawings, in which like reference numerals designate like parts throughout the figures thereof, and wherein.

DETAILED DESCRIPTION OF THE PREFERRED EMBODIMENTS

Figure 1:
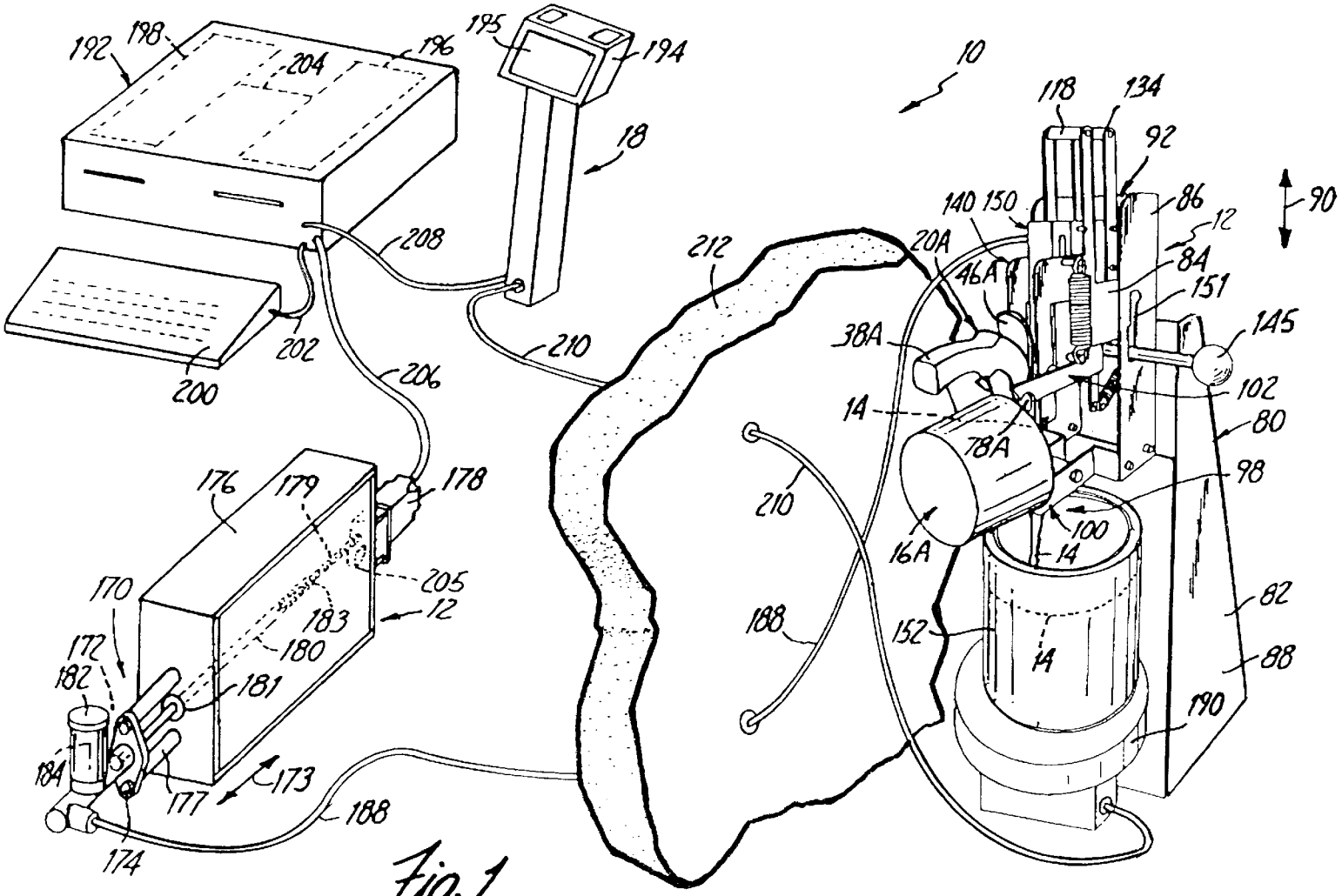
FIG. 1 is a perspective view illustrating a dispensing and control apparatus of a semi-automated system for dispensing liquid paint components from their original containers in ac dance with the present invention.
Figure 2:
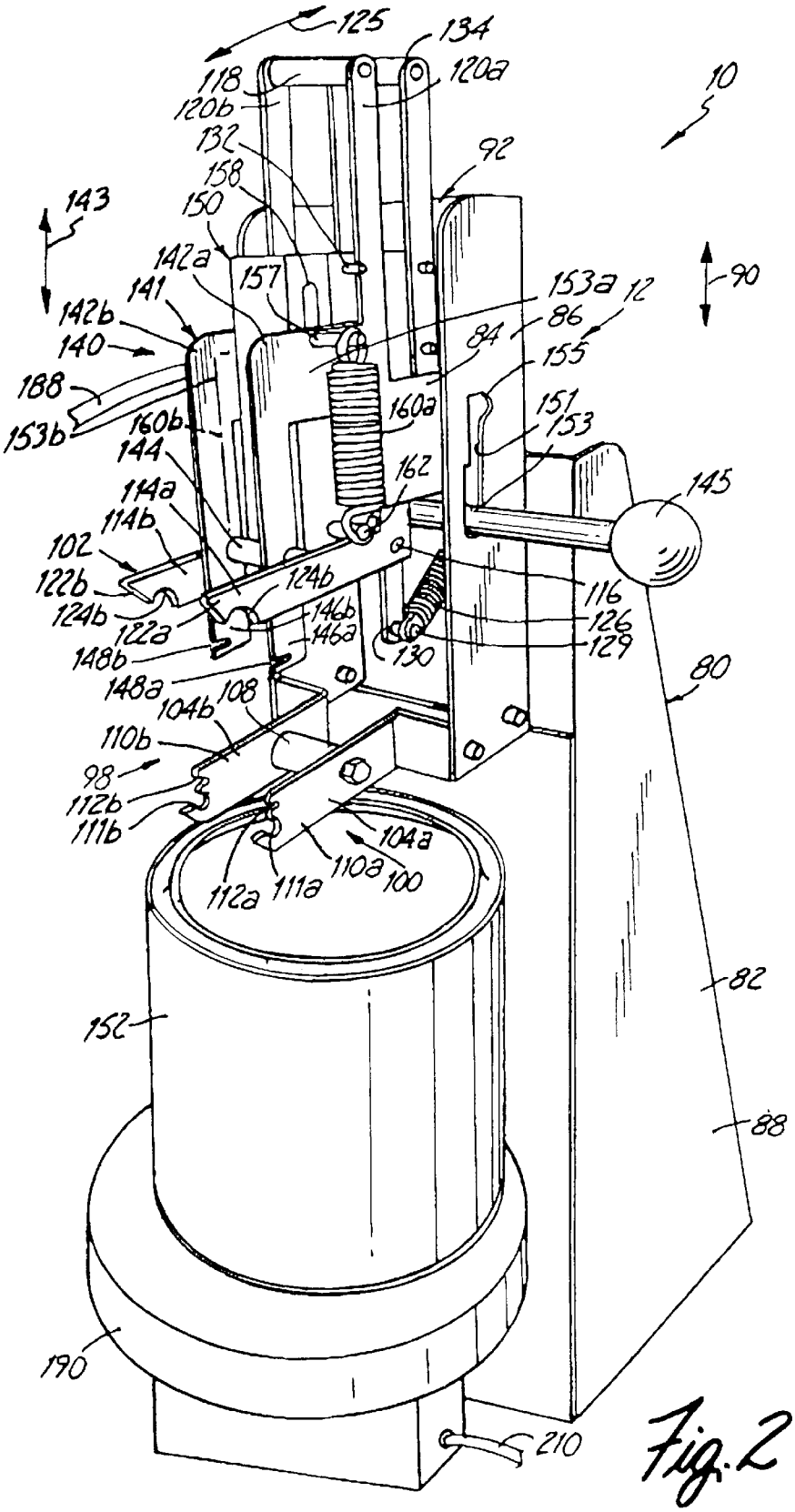
FIG. 2 is a enlarged perspective view better illustrating the dispensing apparatus of the dispensing system of FIG. 1.

A semi-automated dispensing system 10 for dispensing liquid paint components according to a paint formula to form a liquid paint mixture in accordance with the present invention is illustrated generally in FIGS. 1 and 2. The dispensing system 10 generally comprises a dispensing apparatus 12 for dispensing a liquid paint component 14 from its original container 16A and 16B, and a control apparatus 18 for controlling the dispensing apparatus 12. FIGS. 1, 3–7 show the quart size original container 16A having a lid member 20A, while FIG. 8 illustrates the gallon size original container 16B having a lid member 20B. The containers 16A and 16B (without the lid members 20A and 20B) are typical metal vessels within which liquid paint components 14, such as tints, colorants, pearls, metallics, binders and balancers (used to mix automotive paint according to a paint formula) are shipped from a liquid paint component manufacturer to customers, such as body shops and jobbers. Beyond their size differences, the quart size and gallon size containers 16A and 16B and lid members 20A and 20B are substantially identical, therefore only the quart size original container 16A and lid member 20A will be described with particularity.

Figure 3:
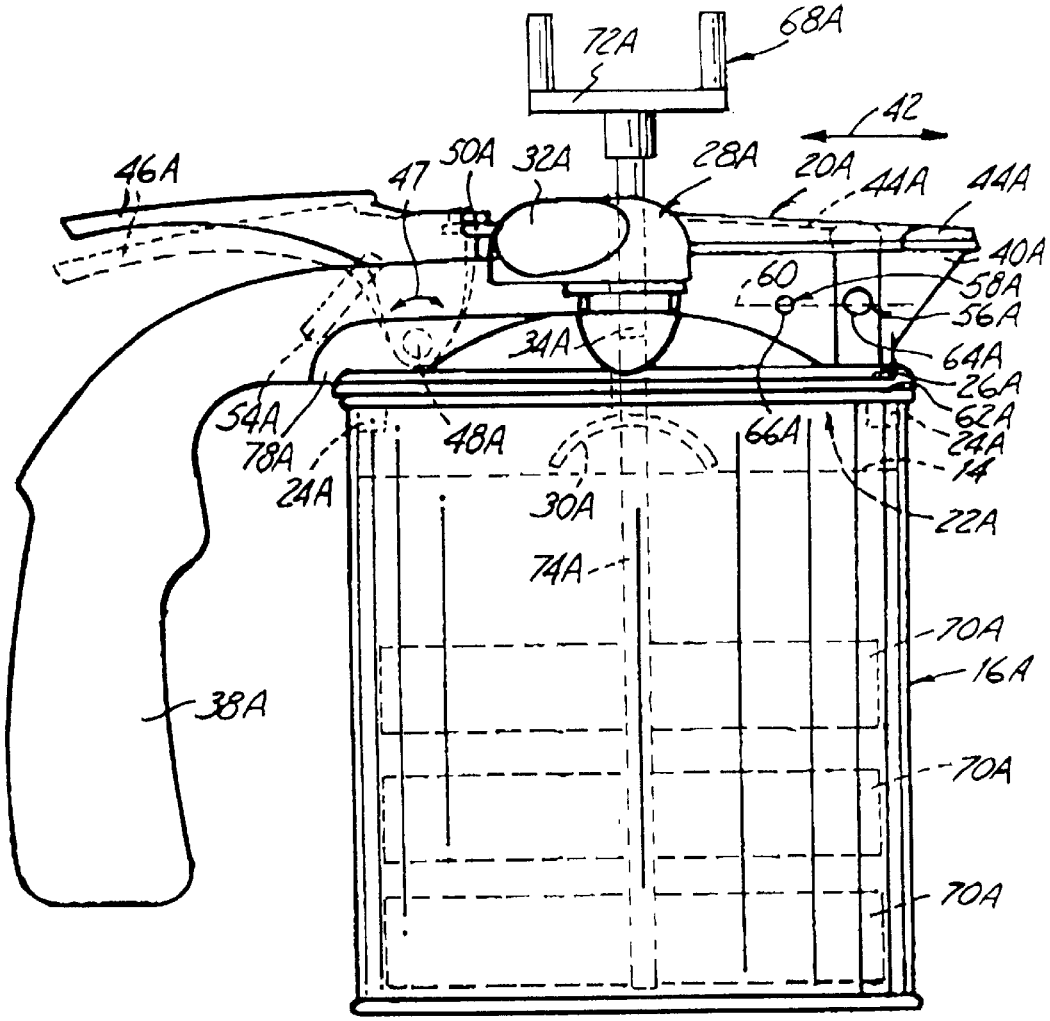
FIG. 3 is a side elevational view of a quart size original paint container and lid member for holding a liquid paint component.
Figure 4:
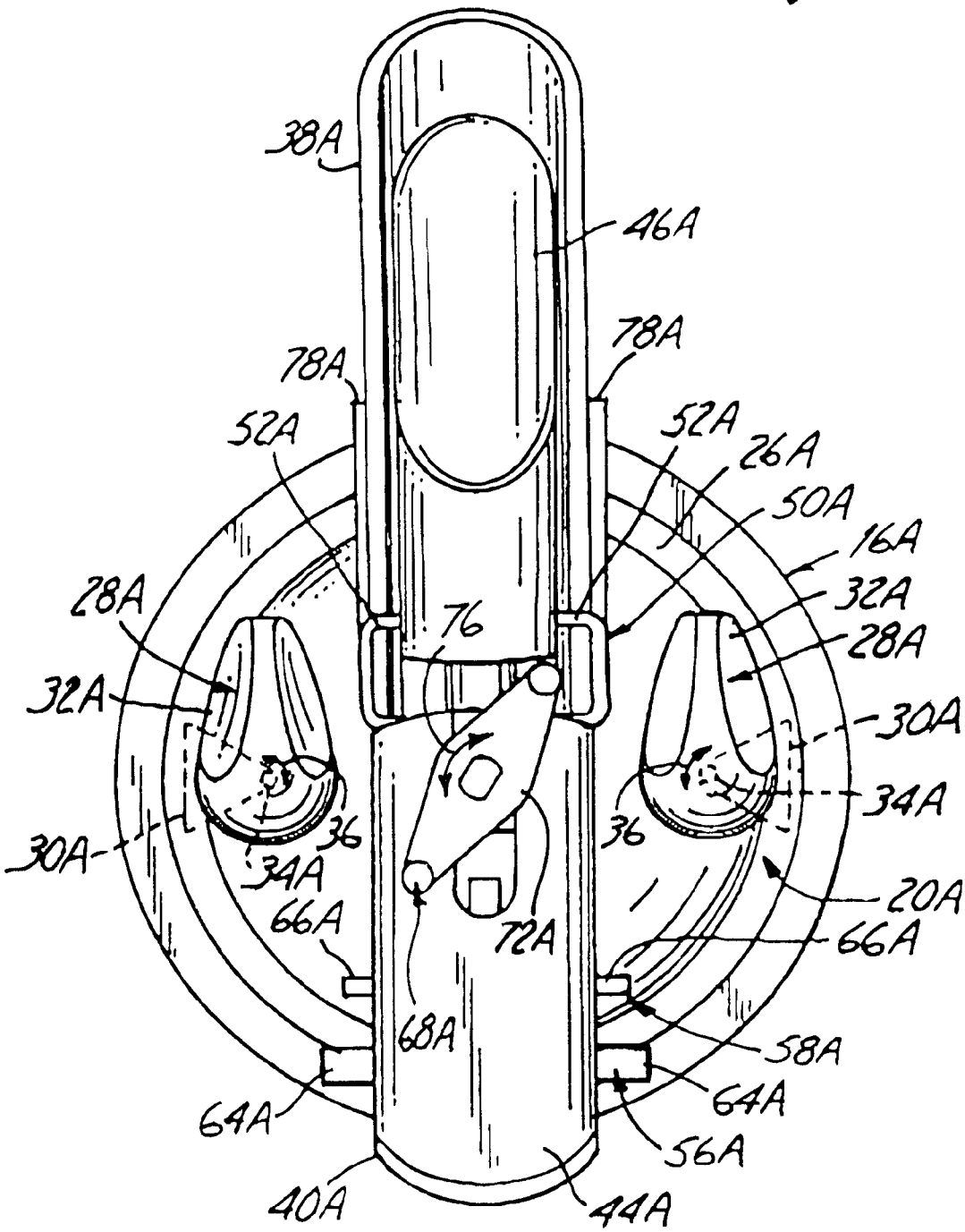
FIG. 4 is top elevational view of the paint container and lid member shown in FIG. 3.

As seen best in FIGS. 3 and 4, the original container 16A is cylindrical shaped having an open top 22A defined by a circumferential lip 24A. The lid member 20A includes a base portion 26A adapted to engage and seal the open top 22A of the container 16A to protect the liquid paint component 14 within the container 16A. The base portion 26A of the lid member 20A includes a pair of spaced, pivotable cam lock mechanisms 28A that are used to releasably secure the lid member 20A to the original container 16A. Each of the cam lock mechanisms 28A is defined by a cam element 30A connected to a cam actuator 32A by way of a post member 34A. Pivotally moving the cam actuators 32A by hand, as represented by double headed arrow 36, moves the cam elements 30A into and out of engagement with the lip 24A to secure and release the lid member 20A from the original container 16A.

The lid member 20A further includes a handle 38A, for easy handling of the original container 16A when the lid member 20A is secured thereto, and a liquid paint component pour spout 40A. The pour spout 40A is covered by a linearly movable, as represented by double headed directional arrow 42, cover element 44A. The cover element 44A is linearly movable between a closed state (shown in solid lines in FIG. 3) and an opened state (shown in dashed lines in FIG. 3). In the closed state of the cover element 44A, the liquid paint component 14 is prevented from being poured (i.e., dispensed) from the original container 16A through the pour spout 40A. In the opened state of the cover element 44A, the liquid paint component 14 can be poured from the original container 16A through the pour spout 40A by tilting the container 16A using the handle 38A.

As seen in FIG. 3, the cover element 44A is movable between its closed and opened states via a thumb actuator 46A that is pivotally secured to the base portion 26A by way of a pivot pin 48A. The thumb actuator 46A is pivotally movable as shown by double headed directional arrow 47. As seen best in FIG. 4, the thumb actuator 46A is connected to the cover element 44A via a wire loop 50A. The wire loop 50A includes end edges 52A (FIG. 4), the purpose of which will become clear below. When the thumb actuator 46A is positioned as shown in solid lines in FIG. 3, the cover element 44A is in its closed state. The thumb actuator 46A is biased to this normal position by a spring element 54A (FIG. 3) that acts between the base portion 26A and the thumb actuator 46A. When the thumb actuator 46A positioned as shown in dashed lines in FIG. 3, the cover element 44A is in its opened state. The cover element 44A is moved, from its closed state to its opened state, through the connecting wire loop 50A by pivoting the thumb actuator 46A about the pivot pin 48A against the bias of the spring element 54A. The cover element 44A is allowed to return to its closed state from the opened state by simply releasing the thumb actuator 46A.

As seen best in FIG. 4, the lid member 20A further includes a first and second spaced alignment rods 56A and 58A, respectively, positioned at a first portion of the lid member 20A at the pour spout 40A adjacent to the cover element 44A. As seen in FIG. 3, the first and second alignment rods 56A and 58A are positioned so as to define a plane 60 that is parallel to an upper surface 62A of the circumferential lip 24A of the original container 16A. The first alignment rod 56A is longer than and has a diameter greater than the second alignment rod 58A. Free ends of the first and second alignment rods 56A and 58A define first and second pairs of registration lugs 64A and 66A, respectively, the purpose of which will become clear below. The first and second alignment rods 56A and 58A are mounted to the lid member 20A by first drilling holes for the alignment rods 56A and 58A at the pour spout 40A. The first and second alignment rods 56A and 58A are then press fit into the drilled holes.

As seen best in FIG. 3, the lid member 20A further includes a stirring device 68A for stirring the liquid paint component 14 within the original container 16A. The stirring device 68A includes a plurality of paddles 70A connected to a paddle actuator 72A by way of a shaft member 74A. Rotating the paddle actuator 72A, as represented by double headed directional arrow 76 (FIG. 4), causes rotation of the paddles 70A and stirring of the liquid paint component 14. The paddle actuator 72A is driven (i.e., rotated) by a stirring mechanism (not shown) that is part of a storage rack (not shown) for holding various original containers 16A of liquid paint components 14.

Lastly, as seen best in FIG. 4, the base portion 26A of the lid member 20A includes a pair of spaced latch lugs 78A positioned at a second portion of the lid member 20A to either side of the thumb actuator 46A. The purpose of these latch lugs 78A will become clear below.

As seen best in FIGS. 1 and 2, the dispensing apparatus 12 of the dispensing system 10 includes a support frame 80 defined by a main support structure 82 and an ancillary support structure 84. The main support structure 82 has an upper portion 86 that is rigidly fixed to a lower portion 88. The ancillary support structure 84 is linearly movable, as represented by double headed directional arrow 90, relative to the upper portion 86 of the main support structure 82 via a slide mechanism 92. As seen best in FIG. 5, in one preferred embodiment, the slide mechanism 92 includes a channel member 94 on the upper portion 86 of the main support structure 82 that slidably receives a T-shaped slide member 96 on the ancillary support structure 24. However, the slide mechanism 92 can comprise other shaped slide components as long as the components permit linear movement of the ancillary support structure 84 relative to the main support structure 82 along directional arrow 90.

Figure 5:
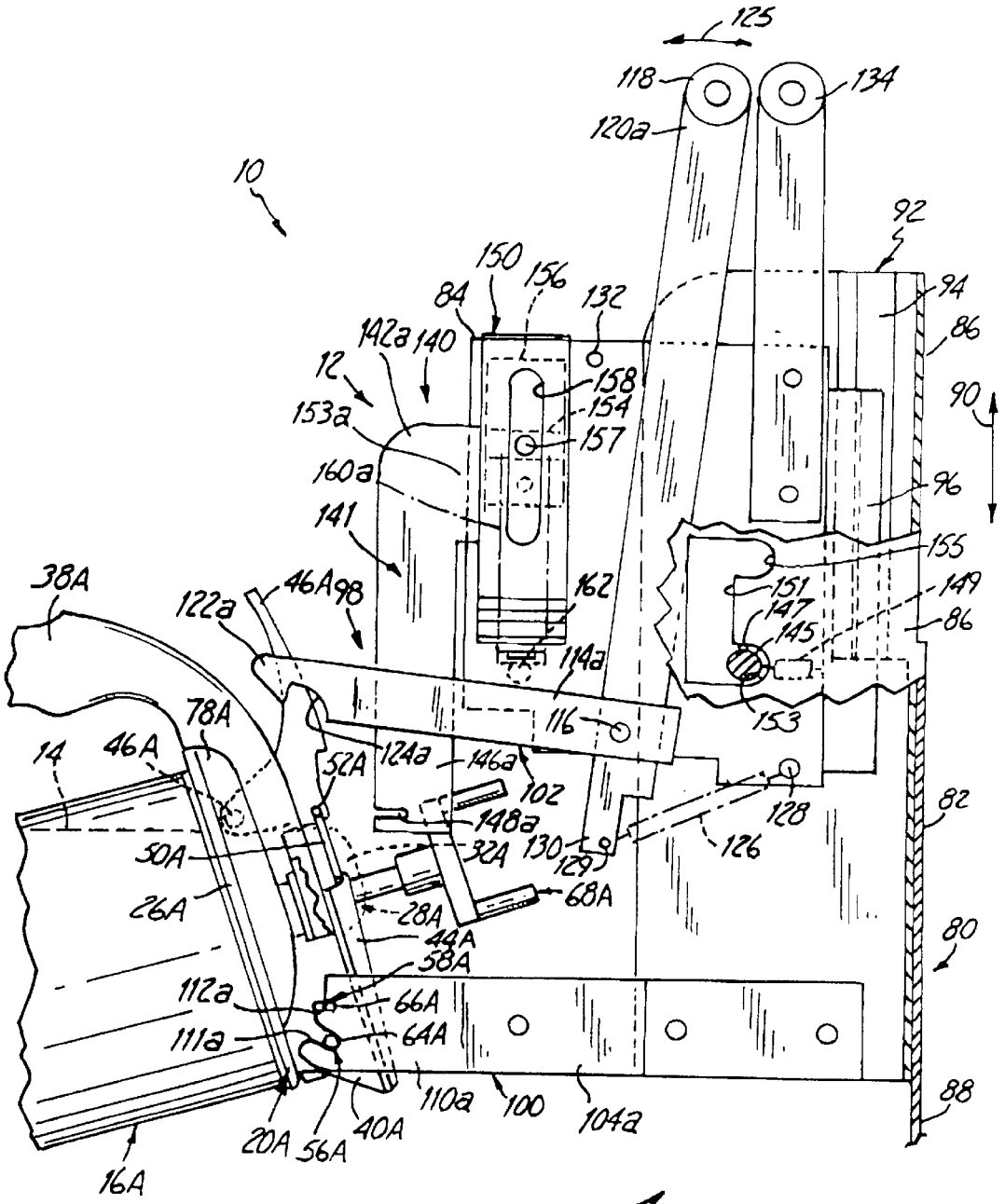
FIG. 5 is partial side elevational view with some parts omitted for clarity of the dispensing apparatus of FIGS. 1 and 2, illustrating a quart size original container of a paint component being loaded into/unloaded from the dispensing apparatus.

As seen best in FIGS. 2 and 5, the dispensing apparatus 12 further includes a receiving mechanism 98 for releasably engaging the original container 16A, 16B of the liquid paint component 14. The receiving mechanism 98 is defined by first and second engaging mechanisms 100 and 102, respectively.

As seen best in FIG. 2, the first engaging mechanism 100 includes first and second spaced arms 104*a* and 104*b* rigidly mounted to the upper portion 86 of the main support structure 82. A bight member 108 rigidly connects together the first and second arms 104*a* and 104*b* near their free ends 110*a* and 110*b*. The free ends 110*a* and 110*b* of the first and second spaced arms 104*a* and 104*b* include first registration notches 111*a* and 111*b*, and second registration notches 112*a* and 112*b*. The first registration notches 111*a* and 111*b* are adapted to releasably receive (i.e., engage) the registration lugs 64A of the first alignment rod 56A for the lid member 20A. The second registration notches 112*a* and 112*b* are adapted to releasably receive (i.e., engage) the registration lugs 66A of the second alignment rod 58A for the lid member 20A. The first registration notches 111*a* and 111*b* are of a different size than the second registration notches 112*a* and 112*b*. This ensures that first registration notches 111*a* and 111*b* and the second registration notches 112*a* and 112*b* receive the correct sized alignment rod 56A and 58A, respectively. As seen in FIG. 5, interengagement of the registration lugs 64A and 66A of the alignment rods 56A and 58A with the registration notches 111*a*,111*b*, 112*a*, 112*b*, mounts (i.e., secures) and aligns a first portion of the container 16A and lid member 20A combination to the receiving mechanism 98 of the dispensing apparatus 12.

The second engaging mechanism 102 includes first and second spaced L-shaped arms 114*a* and 114*b* pivotally mounted to the ancillary support structure 84 via a pivot pin 116. A handle member 118 rigidly connects together the first and second L-shaped arms 114*a* and 114*b* at their first ends 120*a* and 120*b*. Second ends 122*a* and 122*b* of the first and second L-shaped arms 114*a* and 114*b* include latching notches 124*a* and 124*b*. The latching notches 124*a* and 124*b* are adapted to releasably receive (i.e., engage) the latch lugs 78A of the lid member 20A for the original container 16A. The L-shaped arms 114*a* and 114*b* of the second engaging mechanism 102 are pivotally movable as a unit, as represented by double headed arrow 125, between an unlatched state, wherein the original container 16A of the liquid paint component 14 can be engaged with and disengaged from the first and second engaging mechanisms 100 and 102 (shown in FIG. 5); and a latched state, wherein the original container 16A is securely held between the first and second engaging mechanisms 100 and 102 (shown in FIG. 6). A tension spring element 126 is coupled between a mounting peg 128 of the ancillary support structure 84 and a mounting peg 129 of an extension arm 130 on the L-shaped arm 114*a*. The tension spring element 126 biases the L-shaped arms 114*a* and 114*b* defining the second engaging mechanism 102 to the latched state against the stop member 132.

As seen best in FIGS. 2 and 5, the dispensing apparatus 12 of the dispensing system 10 further includes dispensing mechanism 140 mounted to the ancillary support structure 84 for moving the cover element 44A of the lid member 20A between its closed and open states. The dispensing mechanism 140 includes downwardly extending, first and second arms 142*a* and 142*b* that define an operating device 141 linearly movable, as a unit, as represented by double headed directional arrow 143 (FIG. 2), relative to the ancillary support structure 84. A bight member 144 rigidly connects together the first and second arms 142*a* and 142*b* near their free ends 146*a* and 146*b*. The free ends 146*a* and 146*b*, of the first and second arms 142*a* and 142*b*, include wire loop notches 148*a* and 148*b* adapted to releasably engage the end edges 52A of the wire loop 50A on the lid member 20A (see FIG. 6).

Figure 6:
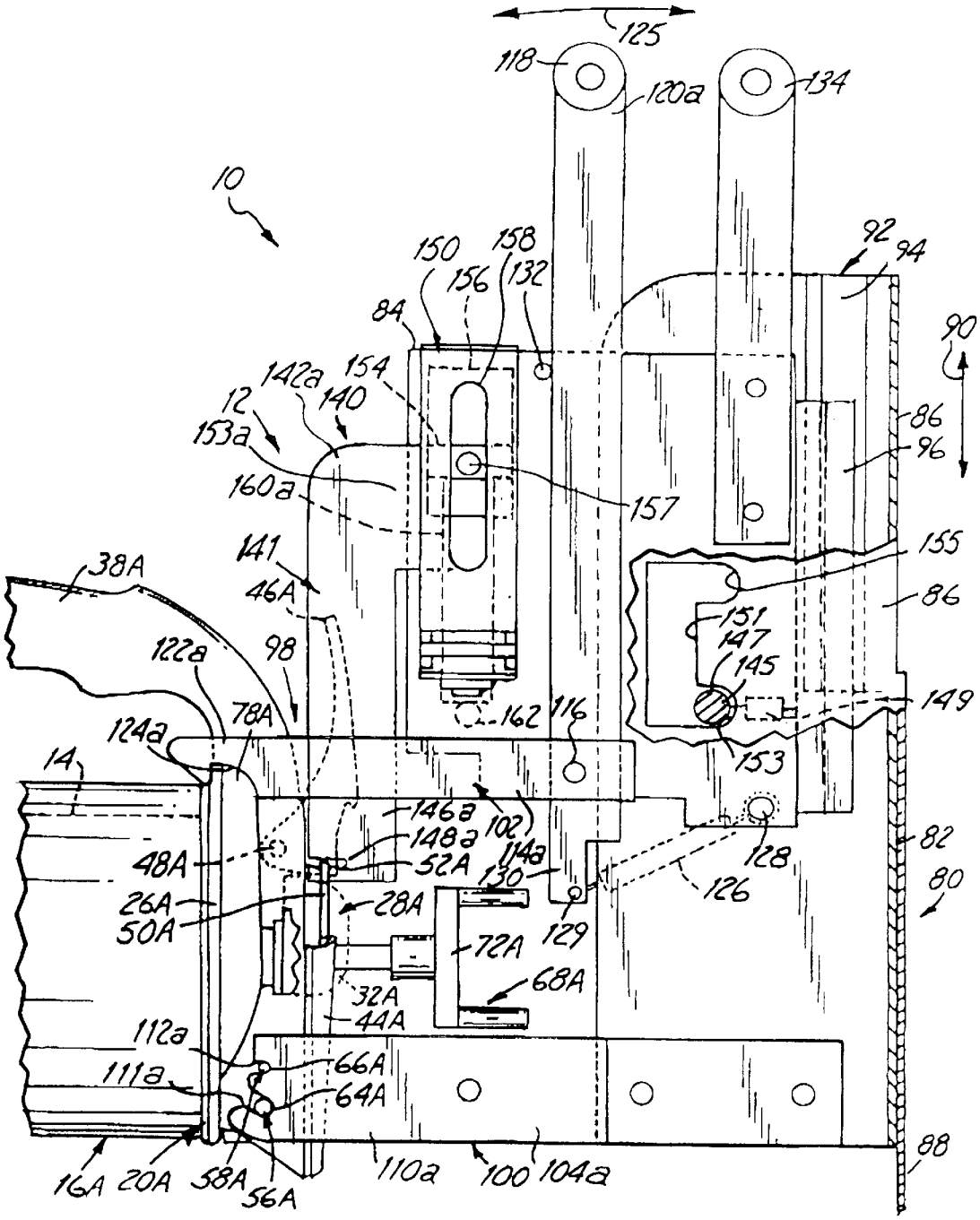
FIG. 6 is partial side elevational view with some parts omitted for clarity similar to FIG. 5, illustrating the quart size original container ready for dispensing of the liquid paint component.
Figure 7:
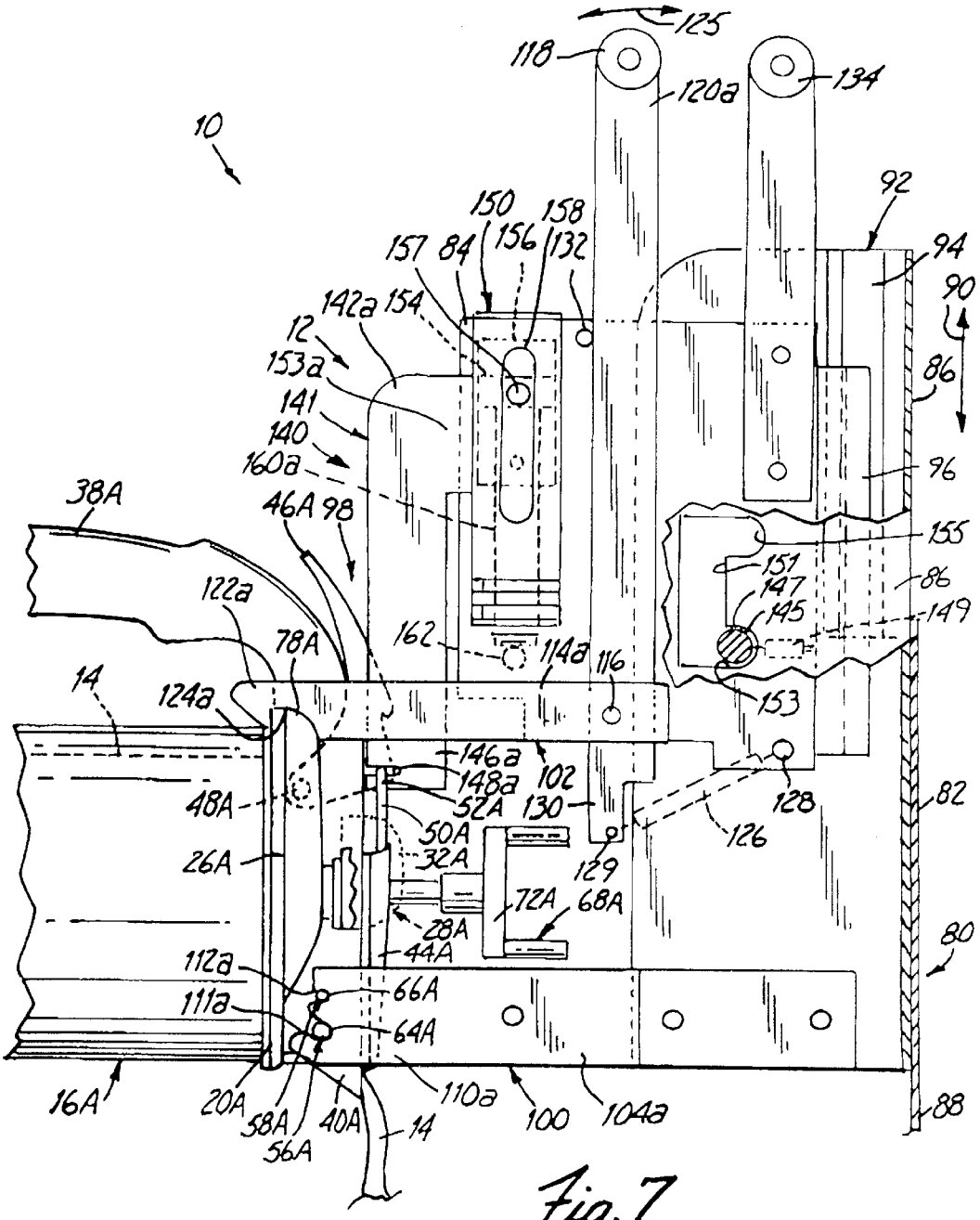
FIG. 7 is partial side elevational view with some parts omitted for clarity similar to FIG. 6, illustrating the liquid paint component being dispensed from its quart size original container.
Figure 8:
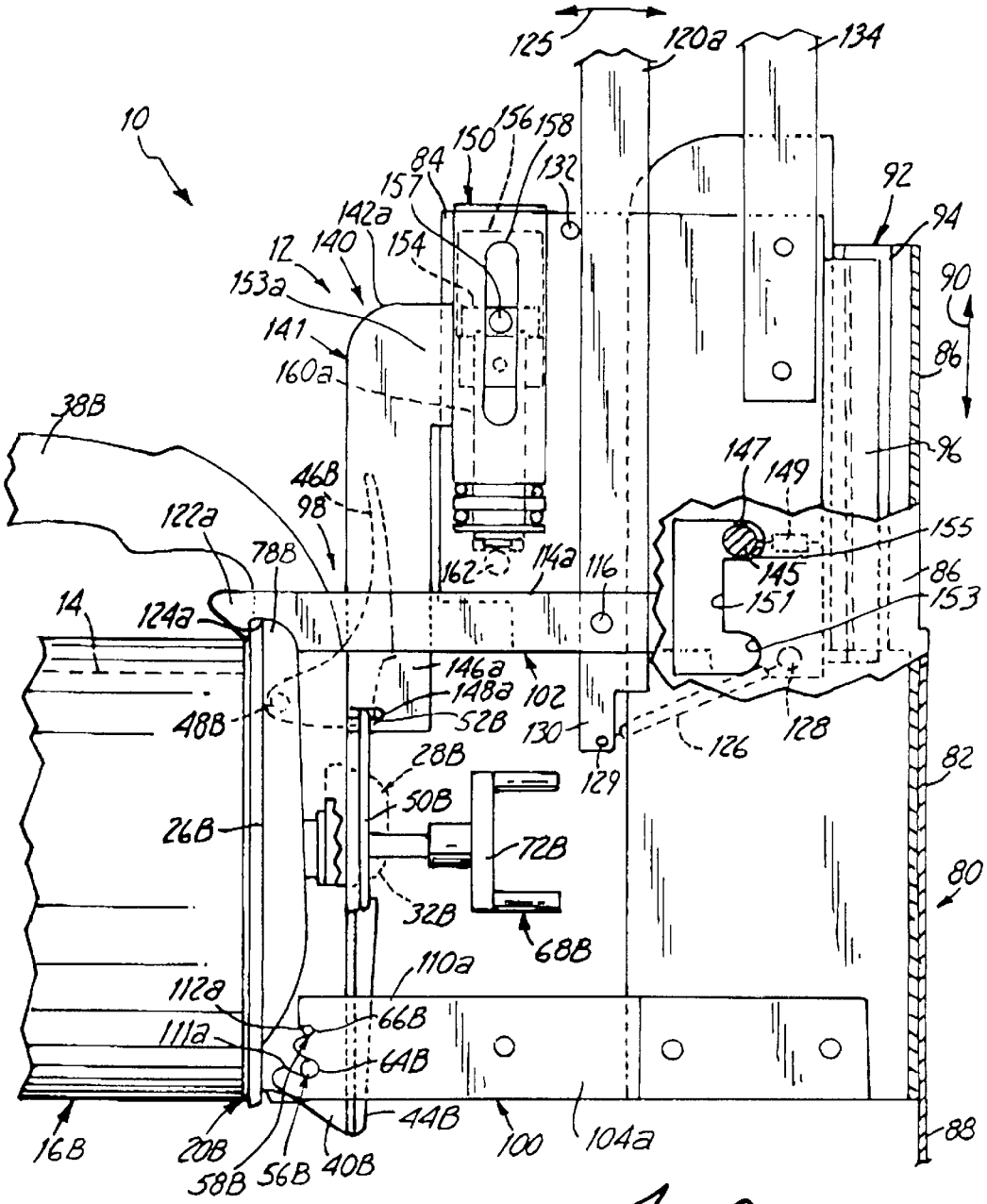
FIG. 8 is partial side elevational view with some parts omitted for clarity similar to FIG. 6, illustrating a gallon size original container ready for dispensing of a liquid paint component.

As seen in FIG. 7, with the loop notches 148*a* and 148*b* of the operating device 141 engaged with the end edges 52A of the wire loop 50A (which is connected to the cover element 44A), a transit mechanism 150 of the dispensing mechanism 140 can move the operating device 141 between a first position and a second position. In the first position of the operating device 141 (FIG. 6), the cover element 44A of the lid member 20A is in its closed state which prevents the liquid paint component 14 from being dispensed from the original container 16A. In the second position of the operating device 141 (FIG. 7), the cover element 44A is in its opened state which allows the liquid paint component 14 to be dispensed (i.e., poured) from the original container 16A into a paint receptacle 152 (FIG. 1).

As set forth previously, the ancillary support structure 84 is linearly movable, as represented by the double headed directional arrow 90, relative to the upper portion 86 of the main support structure 82 via a slide mechanism 92. This allows the receiving mechanism 98 (defined by the first and second engaging mechanisms 100 and 102) and the dispensing mechanism 140 to accommodate quart size original containers 16A (FIGS. 5–7) and gallon size original containers 16B (FIG. 8). As seen in FIGS. 2 and 5–8, the ancillary support structure 84 includes latch lever member 145 that is pivotally movable about a pivot pin 147 between a latched position and an unlatched position. The latch lever member 145 is biased to the latched position via a tension spring 149 extending between the lever member 145 and the ancillary support structure 84. The latch lever arm 145 rides in a latch slot 151 in the upper portion 86 of the main support structure 82. The latch slot 151 includes a quart size or primary latch notch 153 and a gallon size or secondary latch notch 155. In operation, to move the ancillary support structure 84 from its primary (i.e., quart) position to its secondary (i.e., gallon) position, all a system operator need do is pivot the lever member 145 about the pivot pin 147 against the bias of the spring 149 from the quart size latch notch 153 to the latch slot 151. The operator then moves the ancillary support structure 84 upward using the lever member 145. This causes the second engaging mechanism 102 and the dispensing mechanism 140 to move away from the first engaging mechanism 100, allowing more space so as to accommodate the gallon size original container 16B. Once the latch lever member 145 reaches the top of the latch slot 151 the operator then moves the lever member 145 into the gallon size latch notch 155 and the dispensing apparatus is ready to accommodate a gallon size container 16B. To re-accommodate quart size containers 16A this procedure is simply reversed.

As seen best in FIGS. 5–7, the transit mechanism 150 of the dispensing mechanism 140 includes a piston member 154 linearly movable, along directional arrow 143 (FIG. 2), relative to a cylinder member 156. Opposite ends 153*a* and 153*b* of the first and second arms 142*a* and 142*b* (defining the operating device 141) are rigidly coupled to the piston member 154 via a shaft member 157 that extends through a longitudinal slot 158 of the cylinder member 156. Therefore movement of the piston member 154 within the cylinder member 156 causes the operating device 141 to move between its first and second positions. Tension spring elements 160*a* and 160*b* are coupled between the shaft member 157 and a mounting member 162 on the ancillary support structure 84. The tension springs 160*a*, 160*b* bias the operating device 141 to its first position (also known as the primary position of the piston member 154).

As seen in FIG. 1, a drive mechanism 170 of the transit mechanism 150 moves the piston member 154 relative to the cylinder member 156. The drive mechanism 170 includes a piston member 172 linearly movable, along double headed directional arrow 173, relative to a cylinder member 174 mounted to a frame 176 via bracket structure 177. A drive motor, such as a stepper motor 178, is also mounted to the frame 176. The drive motor 178 includes a drive screw 179 that is telescopically received within a drive tube 180 that is secured at one end to the piston member 172. The drive tube 180 is slidably received within a bearing 181 of the frame 176 to allow movement of the drive tube 180, and the piston member 172 therewith, relative to the frame 176, drive motor 178 and cylinder member 174. An opposite end of the drive tube 180 includes a drive nut 183 that threadably receives the drive screw 179 of the stepper motor 178. Operation of the stepper motor 178 turns the drive screw 179 within the drive nut 183. This in turn moves the drive tube 180 and therewith the piston member 172 within the cylinder member 174 along directional arrow 173. A fluid reservoir 182 containing a hydraulic fluid 184 is in fluid communication with the cylinder member 174. A fluid line 188 couples the fluid reservoir 182 to the cylinder member 156. In operation, movement of the piston member 172, via the stepper motor 178, forces hydraulic fluid 184 to move to and from the cylinder member 174 and the fluid reservoir 182 through the line 188 then into and out of the cylinder member 156 to move the piston member 154. Movement of the piston member 154, via the above described hydraulic fluid pressure, in turn moves the operating device 141 which in turn moves the cover element 44A of the lid member 20A between its opened and closed states.

As seen in FIG. 1, the control apparatus 18 of the dispensing system 10 includes a weigh cell 190 for supporting the paint receptacle 152 and a control module 192. The weigh cell 190 determines the weight of the liquid paint component dispensed (i.e., poured) from the original container 16A into the paint receptacle 152. The control module 192 includes a display monitor device 194 having a display 195, a microprocessor device 196, a data storage device 198 and a user interface device, such as a keyboard 200. The keyboard 200 is coupled to the microprocessor device 196 via a communication line 202. The microprocessor device 196 and the data storage device 198 are linked through a communication line 204. The microprocessor device 196 is linked to the stepper motor 178 and to a sensor 205 for monitoring the position of the drive screw 179 through the communication line 206. The microprocessor device 196 is linked to the display monitor device 194 through communication line 208 and is further linked to the weigh cell 190 via communication line 210. Since the control module 192 (i.e., microprocessor device 196) is linked to the stepper motor 178 and the sensor 205, the control module 192 can control operation of the stepper motor 178, and thereby movement of the piston members 172 and 154, and hence movement ofthe cover element 44A to dispense the liquid paint component 14 from the original container 16A. In addition, since the control module 192 is further linked to the weigh cell 190, the control module 192 can control the amount (i.e., the weight) of the liquid paint component 14 dispensed from its original container 16A to the paint receptacle 152 (atop the weigh cell 190) based upon data (i.e., information) obtained from the weigh cell 190. Moreover, since the control module 192 (i.e., the data storage device 198) stores the paint formulas, the control module 192 can determine which liquid paint components 14 and the weights of these components needed to duplicate a particular paint formula and can control the dispensing mechanism 140 in accordance therewith.

As seen in FIG. 1, the control module 192 and the drive mechanism 170 are positioned in another room such that the communication line 210 and the fluid line 188 pass through a wall 212 so as to provide explosion protection for the dispensing system 10.

In operation, to mix a particular paint formula, the operator of the semi-automated dispensing system 10 first accesses the control module 192 through the keyboard 100 to call up the desired paint formula using the microprocessor device 196 the data storage device 198. The paint formula (i.e., the liquid paint components 14) is then displayed on the display 195 of the display monitor device 194. The operator then loads the first container 16A, 16B of the needed liquid paint components into the dispensing apparatus 12.

As seen in FIG. 5, to mount (i.e., load) an original container 16A of a liquid paint component 14 to the receiving mechanism 98 of the dispensing apparatus 12, the operator of the dispensing system 10 first needs to pivot the second engaging mechanism 102 (defined by the L-shaped arms 114*a*, 114*b*) clockwise (as viewed in FIG. 5) from its normal latched state to its unlatched state, against the handle/stop member 134 mounted to the ancillary support structure 84. The operator, while gripping both the handle member 118 and the handle/stop member 134 to hold the second engaging mechanism 102 in its unlatched state (against the bias of the spring element 126), then engages the registration lugs 64A of the first alignment rod 56A for the lid member 20A with the first registration notches 111*a*, 111*b* of the first engaging mechanism 100 (FIG. 5). Next, while still holding the second engaging mechanism 102 in its unlatched state, the operator pivots the container 16A and lid member 20A combination clockwise (as viewed in FIG. 5) until the registration lugs 66A of the second alignment rod 58A are fully seated in the second registration notches 112*a*, 112*b* of the first engaging mechanism 100; and the end edges 52A of the wire loop 50A are fully seated in the wire loop notches 148*a*, 148*b* of the operating device 141. With the registration lugs 64A and 66A now fully seated in the registration notches 111*a*, 111*b*, 112*a*, 112*b*, and the end edges 52A fully seated in the loop notches 148*a*, 148*b*, the operator pivots the second engaging mechanism 102 counter-clockwise to its latched state, so that the latching notches 124*a* and 124*b* engage the latch lugs 78A of the lid member 20A securing the original container 16A lid member 20A combination to the receiving mechanism 98 the dispensing apparatus 12. To remove the container 16A for the dispensing apparatus 12, this above described process is simply reversed.

The operator then starts the dispensing process using the keyboard 200 of the control module 192. Since the control module 192 (i.e., microprocessor device 196) is linked to the stepper motor 178 and the sensor 205, the control module 192 controls operation of the stepper motor 178, and thereby movement of the piston members 154 and 172, and hence movement of the cover element 44A to dispense (i.e., pour) the liquid paint component 14 from the original container 16A into the paint receptacle 152. The shape of the second registration notches 112*a*, 112*b* together with the second alignment pin 58A prevents movement of the cover element 44A from inadvertently disengaging the first alignment pin 56A from the first registration notches 111*a*, 111*b*. The weight of the liquid paint component 14 dispensed into the paint receptacle 152 is monitored by the control module 192 through the weigh cell 190, thereby ensuring an accurate liquid paint component pour. Once the first liquid paint component 14 is poured, its container 16A, 16B is removed and is replaced with the next paint component container 16A, 16B and so on, until all paint components 14 of the paint formula have been added to the paint receptacle 152, thereby completing the paint formula mixing process.

This semi-automated dispensing system 10, for dispensing liquid paint components 14 from their original containers 16A, 16B according to a paint formula to form a liquid paint mixture, virtually eliminates system operator errors, in particular over pouring errors, that can be costly to a body shop or jobber. The semi-automated dispensing system 10 is easy to use, and does not require a highly skilled operator, since operator interface with the dispensing system 10 is substantially limited to identifying the desired paint formula, and loading and unloading the proper containers 16A, 16B of the liquid paint components 14 to and from the dispensing apparatus 12. In the semi-automated dispensing system 10 of the present invention, the operator need no longer manually pour the paint components 14 from their containers 16A, 16B. The control module 192 controlled dispensing mechanism 140 of the semi-automated dispensing system 10 automatically dispenses (i.e., pours) the liquid paint components 14 from their containers 16A, 16B, thereby ensuring a highly accurate, precision liquid paint component pour. In addition, the paint dispensing system 10 makes efficient use of the operator's time, since the operator is free to perform other duties instead of holding the containers 16A, 16B and performing the task of manually pouring the proper amounts of the liquid paint components 14. This efficiency gain allows the operator to mix a greater number of paint formulas during a work day. Lastly, the semi-automated dispensing system 10 of the present invention complies with all regulations and laws, such as being explosion protected, governing the handling and mixing of liquid paint components 14 for the duplication of automotive paint formulas.

Although the present invention has been described with reference to preferred embodiments, workers skilled in the art will recognize that changes may be made in form and detail without departing from the spirit and scope of the invention. For example, although the semi-automated dispensing system 10 has been described as useable to dispense liquid automotive paint components 14 from their original containers 16A and 16B, the dispensing system can be used to dispense other pourable components, such as primers, thinners and liquid or powdered chemicals. In particular the dispensing system 10 could be used in laboratory or pharmaceutical organizations to accurately dispense liquid and powdered chemicals according to a desired formula.

What is claimed is:

1. A system for dispensing pourable components from their original containers into a receptacle according to a formula to form a mixture of pourable components, each of the original containers including a lid member, the dispensing system comprising:

a dispensing apparatus for dispensing a pourable component from its original container, the original container having a lid member, the dispensing apparatus including:

a support frame;

means, coupled to the support frame, for releasably receiving the original container, the receiving means including:

first means for engaging a first portion of the lid member, and second means for engaging a second portion of the lid member, the second portion being spaced from the first portion; and means, coupled to the support frame, for dispensing the pourable component from its original container into a receptacle; and an apparatus for controlling the dispensing apparatus, including:

a weigh cell for supporting the receptacle and for determining the weight of the pourable component dispensed into the receptacle; and a control module coupled to the weigh cell and the dispensing means for controlling the amount of the pourable component dispensed from its original container, based upon information obtained from the weigh cell.

2. The dispensing system of claim 1 wherein the lid member of the original container has a cover element that can be moved between a closed state and an opened state, and wherein the dispensing means includes:

an operating device for releasably engaging the cover element, the operating device being movable between a first position, wherein the cover element is in the closed state and the pourable component is prevented from being dispensed from the original container, and a second position, wherein the cover element is in the opened state and the pourable component is dispensed from the original container and into the receptacle.

3. The dispensing system of claim 2 wherein the dispensing means further includes:

a mechanism for moving the operating device between the first and second positions.

4. The dispensing system of claim 3 wherein the mechanism for moving the operating device includes:

a cylinder member;

a piston member coupled to the operating device, the piston member being movable within the cylinder member, such that movement of the piston member causes the operating device to move between the first and second positions; and a drive mechanism coupled to the piston member for moving the piston member relative to the cylinder member.

5. The dispensing system of claim 4 wherein the drive mechanism is fluid pressure.

6. The dispensing system of claim 5 wherein the fluid pressure is hydraulic fluid pressure.

7. The dispensing system of claim 4 wherein the piston member has a primary position that corresponds to the first position of the operating device, and wherein the mechanism for moving the operating device further includes:

a mechanism for biasing the piston member to the primary position.

8. The dispensing system of claim 7 wherein the biasing mechanism includes at least one spring connected between the support frame and the operating device.

9. The dispensing system of claim 4 wherein the drive mechanism includes:

a cylinder member;

means connecting the cylinder member of the drive mechanism to the cylinder member of the mechanism for moving the operating device;

a piston member movable relative to the cylinder member of the drive mechanism, such that movement of the piston member of the drive mechanism causes movement of the piston member of the mechanism for moving the operating device; and a drive motor coupled to the piston member of the drive mechanism for moving the piston member of the drive mechanism relative to the cylinder member of the drive mechanism.

10. The dispensing system of claim 9 wherein the connecting means of the drive mechanism includes:

a fluid reservoir in fluid communication with the cylinder member of the drive mechanism and the cylinder member of the mechanism for moving the operating device; and a fluid within the fluid reservoir.

11. The dispensing system of claim 10 wherein the connecting means further includes:

a fluid line coupled between the drive mechanism cylinder member and fluid reservoir, and the cylinder member of the mechanism for moving the operating device.

12. The dispensing system of claim 10 wherein the fluid is hydraulic fluid.

13. The dispensing system of claim 9 wherein the control module is coupled to the drive motor for controlling operation of the drive motor and thereby movement of the piston member of the drive mechanism based upon information obtained from the weigh cell.

14. The dispensing system of claim 1 wherein the second engaging means is movable between a latched state, wherein the original container of the pourable component is held between the first and second engaging means, and an unlatched state, wherein the original container can be engaged with and disengaged from the first and second engaging means.

15. The dispensing system of claim 14 wherein an operator of the dispensing system moves the second engaging means between the latched and unlatched states.

16. The dispensing system of claim 14 wherein the means for releasably receiving the original container of the pourable component further includes:

means for biasing the second engaging means to the latched state.

17. The dispensing system of claim 16 wherein the biasing means includes a spring connected between the support frame and the second engaging means.

18. The dispensing system of claim 1 wherein the support frame includes:

a main support structure;

an ancillary support structure; and means for allowing the ancillary support structure to move relative to the main support structure.

19. The dispensing system of claim 18 wherein the first engaging means is mounted to the main support structure and wherein the second engaging means is mounted to the ancillary support structure.

20. The dispensing system of claim 19 wherein the ancillary support structure is movable relative to the main support structure between a primary position, wherein the first and second engaging means receive a first size of the original container of the pourable component, and a secondary position, wherein the first and second engaging means receive a second size of the original container of the pourable component that is different than the first size.

21. The dispensing system of claim 20 wherein the first size is a quart and the second size is a gallon.

22. The dispensing system of claim 20 wherein an operator of the dispensing system moves the ancillary support structure between the primary and secondary positions.

23. The dispensing system of claim 19 wherein the dispensing means is mounted to the ancillary support structure.

24. The dispensing system of claim 1 wherein the control module includes:

a microprocessor device coupled to the weigh cell and the dispensing means;

data storage device coupled to the microprocessor device;

display monitor device coupled to the microprocessor device; and a user interface device for allowing a user to communicate with the microprocessor.

25. The dispensing system of claim 24 wherein the user interface is a keyboard.

26. The dispensing system of claim 1 wherein the pourable component is a liquid paint component, the receptacle is a paint receptacle, the formula is a paint formula, and the mixture of pourable components is a liquid paint mixture.

27. A system for dispensing pourable components from their original containers into a receptacle according to a formula to form a mixture of pourable components, the dispensing system comprising:

a dispensing apparatus for dispensing a pourable component from its original container, the dispensing apparatus including:

a main support structure;

an ancillary support structure;

means, coupled to one of the main and ancillary support structures, for dispensing the pourable component from its original container into a receptacle;

first means, mounted to the main support structure, for releasably engaging a first portion of the original container of the pourable component;

second means, mounted to the ancillary support structure, for releasably engaging a second portion of the original container; and means for allowing the ancillary support structure to move relative to the main support structure between a primary position, wherein the first and second engaging means receive a first size of the original container of the pourable component, and a secondary position, wherein the first and second engaging means receive a second size of the original container of the pourable component.

28. The dispensing system of claim 27 wherein the first size is a quart and the second size is a gallon.

29. The dispensing system of claim 27 wherein the dispensing means is mounted to the ancillary support structure.

30. The dispensing system of claim 27 wherein the original container of the pourable component includes a lid member, and wherein the first and second portions of the original container are first and second portions of the lid member.

31. The dispensing system of claim 27 wherein the second engaging means is movable between a latched state, wherein a desired size of the first and second sizes of the original container of the pourable component is held between the first and second engaging means, and an unlatched state, wherein the desired size of the first and second sizes of the original container can be engaged with and disengaged from the first and second engaging means.

32. The dispensing system of claim 31 wherein an operator of the dispensing system moves the second engaging means between the latched and unlatched states.

33. The dispensing system of claim 27 wherein the dispensing apparatus further includes:

means for biasing the second engaging means to the latched state.

34. The dispensing system of claim 33 wherein the biasing means includes a spring connected between the ancillary support structure and the second engaging means.

35. The dispensing system of claim 27 wherein an operator of the dispensing system moves the ancillary support structure between the primary and secondary positions.

36. The dispensing system of claim 27, and further including:

an apparatus for controlling the dispensing apparatus, including:

a weigh cell for supporting the receptacle and for determining the weight of the pourable component dispensed into the receptacle; and a control module coupled to the weigh cell and the dispensing means for controlling the amount of the pourable component dispensed from its original container, based upon information obtained from the weigh cell.

37. The dispensing system of claim 27 wherein the pourable component is a liquid paint component, the receptacle is a paint receptacle, the formula is a paint formula, and the mixture of pourable components is a liquid paint mixture.

38. A system for dispensing pourable components from their original containers into a receptacle according to a formula to form a mixture of pourable components, the dispensing system comprising:

a dispensing apparatus for dispensing a pourable component from its original container, the dispensing apparatus including:

a support frame;

means, coupled to the support frame, for releasably receiving the original container; and an operating device, coupled to the support frame, for releasably engaging a movable cover element of the original container of the pourable component, the operating device being movable between a first position, wherein the cover element is in a closed state and the pourable component is prevented from being dispensed from the original container, and a second position, wherein the cover element is in an opened state and the pourable component is dispensed from the original container and into a receptacle, the operating device including:

a cylinder member;

a piston member coupled to the operating device, the piston member being movable within the cylinder member, such that movement of the piston member causes the operating device to move between the first and second positions; and a drive mechanism coupled to the piston member for moving the piston member relative to the cylinder member, the drive mechanism including:

a cylinder member;

means connecting the cylinder member of the drive mechanism to the cylinder member of the operating device;

a piston member movable relative to the cylinder member of the drive mechanism, such that movement of the piston member of the drive mechanism causes movement of the piston member of the operating device; and a drive motor coupled to the piston member of the drive mechanism for moving the piston member of the drive mechanism relative to the cylinder member of the drive mechanism.

39. The dispensing system of claim 38 wherein the connecting means of the drive mechanism includes:

a fluid reservoir in fluid communication with the cylinder member of the drive mechanism and the cylinder member of the operating device; and a fluid within the fluid reservoir.

40. The dispensing system of claim 38, and further including:

an apparatus for controlling the dispensing apparatus, including:

a weigh cell for supporting the receptacle and for determining the weight of the pourable component dispensed into the receptacle from the original container; and a control module coupled to the weigh cell and the drive motor for controlling operation of the drive motor based upon information obtained from the weigh cell, and thereby the amount of the pourable component dispensed from its original container into the receptacle.

41. The dispensing system of claim 38 wherein the pourable component is a liquid paint component, the receptacle is a paint receptacle, the formula is a paint formula, and the mixture of pourable components is a liquid paint mixture.

42. A system for dispensing pourable components from their original containers into a receptacle according to a formula to form a mixture of pourable components, the dispensing system comprising:

a dispensing apparatus for dispensing a pourable component from its original container, the original container having a cover element that can be moved between a closed state and an opened state, the dispensing apparatus including:

a support frame;

means, coupled to the support frame, for releasably receiving the original container; and means, coupled to the support frame, for dispensing the pourable component from its original container into a receptacle, the dispensing means including:

an operating device for releasably engaging the cover element, the operating device being movable between a first position, wherein the cover element is in the closed state and the pourable component is prevented from being dispensed from the original container, and a second position, wherein the cover element is in the opened state and the pourable component is dispensed from the original container and into the receptacle, and a mechanism for moving the operating device between the first and second positions, the moving mechanism including:

a cylinder member;

a piston member coupled to the operating device, the piston member being movable within the cylinder member, such that movement of the piston member causes the operating device to move between the first and second positions; and hydraulic fluid pressure for moving the piston member relative to the cylinder member; and an apparatus for controlling the dispensing apparatus, including:

a weigh cell for supporting the receptacle and for determining the weight of the pourable component dispensed into the receptacle; and a control module coupled to the weigh cell and the dispensing means for controlling the amount of the pourable component dispensed from its original container, based upon information obtained from the weigh cell.

43. A system for dispensing pourable components from their original containers into a receptacle according to a formula to form a mixture of pourable components, the dispensing system comprising:

a dispensing apparatus for dispensing a pourable component from its original container, the dispensing apparatus including:

a support structure;

means, coupled to the support structure for dispensing the pourable component from its original container into a receptacle;

means, mounted to the support structure, for releasably engaging the original container of the pourable component, the engaging means having a first state for receiving a first size of the original container of the pourable component, and a second state for receiving a second size of the original container of the pourable component that is different than the first size;

wherein the engaging means includes first engaging means, mounted to the support structure for releasably engaging a first portion of the original container or the pourable component; second engaging means, mounted to the support structure spaced from the first means, the second means engaging a second portion of the original container of the pourable component; and wherein the original container of the pourable component includes a lid member, wherein the first and second portions of the original container are first and second portions of the lid member.

44. The dispensing system of claim 43 wherein the first size is a quart and the second size is a gallon.

45. The dispensing system of claim 43 wherein the dispensing apparatus further includes:

means for allowing relative movement between the first engaging means and the second engaging means between a primary position, wherein the first and second engaging means receive the first size of the original container of the pourable component, and a secondary position, wherein the first and second engaging means receive the second size of the original container of the pourable component.

46. The dispensing system of claim 45 wherein the support structure includes:

a main support structure to which the first engaging means is mounted; and an ancillary support structure to which the second engaging means is mounted, wherein the means for allowing relative movement between the first engaging means and the second engaging means between the primary and secondary positions allows the ancillary support structure to move relative to the main support structure between the primary and secondary positions.

47. The dispensing system of claim 43 wherein the original container of the pourable component includes a lid member, and wherein the lid member has a cover element that can be moved between a closed state and an opened state, and wherein the dispensing means includes:

an operating device for releasably engaging the cover element, the operating device being movable between a first position, wherein the cover element is in the closed state and the pourable component is prevented from being dispensed from the original container, and a second position, wherein the cover element is in the opened state and the pourable component is dispensed from the original container and into the receptacle.

48. The dispensing system of claim 47 wherein the dispensing means further includes:

a mechanism for moving the operating device between the first and second positions.

49. The dispensing system of claim 48 wherein the mechanism for moving the operating device includes:

a cylinder member;

a piston member coupled to the operating device, the piston member being movable within the cylinder member, such that movement of the piston member causes the operating device to move between the first and second positions; and a drive mechanism coupled to the piston member for moving the piston member relative to the cylinder member.

50. The dispensing system of claim 49 wherein the drive mechanism is fluid pressure.

51. The dispensing system of claim 50 wherein the drive mechanism includes:

a cylinder member;

means connecting the cylinder member of the drive mechanism to the cylinder member of the mechanism for moving the operating device;

a piston member movable relative to the cylinder member of the drive mechanism, such that movement of the piston member of the drive mechanism causes movement of the piston member of the mechanism for moving the operating device; and a drive motor coupled to the piston member of the drive mechanism for moving the piston member of the drive mechanism relative to the cylinder member of the drive mechanism.

52. The dispensing system of claim 51, and further including:

an apparatus for controlling the dispensing apparatus, including:

a weigh cell for supporting the receptacle and for determining the weight of the pourable component dispensed into the receptacle; and a control module coupled to the weigh cell and the drive motor for controlling the amount of the pourable component dispensed from its original container, based upon information obtained from the weigh cell.

53. The dispensing system of claim 43, and further including:

an apparatus for controlling the dispensing apparatus, including:

a weigh cell for supporting the receptacle and for determining the weight of the pourable component dispensed into the receptacle; and a control module coupled to the weigh cell and the dispensing means for controlling the amount of the pourable component dispensed from its original container, based upon information obtained from the weigh cell.

54. The dispensing system of claim 43 wherein the control module includes:

a microprocessor device coupled to the weigh cell and the dispensing means;

data storage device coupled to the microprocessor device;

display monitor device coupled to the microprocessor device; and a user interface device for allowing a user to communicate with the microprocessor.

55. The dispensing system of claim 54 wherein the user interface is a keyboard.

56. The dispensing system of claim 43 wherein the pourable component is a liquid paint component, the receptacle is a paint receptacle, the formula is a paint formula, and the mixture of pourable components is a liquid paint mixture.

* * * * *

UNITED STATES PATENT AND TRADEMARK OFFICE

CERTIFICATE OF CORRECTION

PATENT NO. : 6,053,218
DATED : April 25, 2000
INVENTOR(S) : Arie Boers

It is certified that error appears in the above-identified patent and that said Letters Patent is hereby corrected as shown below:

Column 3,
Line 10, please delete "arc" and insert -- are --.

Column 4,
Lines 64-65, please delete "ac dance" and insert -- accordance --.

Column 6,
Line 36, please delete "includes a first" and insert -- includes first --.

Column 10,
Line 11, please delete "ofthe" and insert -- of the --.

Signed and Sealed this

Eighteenth Day of December, 2001

*Attest:*

*Attesting Officer*

JAMES E. ROGAN
*Director of the United States Patent and Trademark Office*